US007636985B2

(12) United States Patent
Greenbank

(10) Patent No.: US 7,636,985 B2
(45) Date of Patent: Dec. 29, 2009

(54) DUAL STAGE HIDDEN HINGE

(76) Inventor: Dan Greenbank, 8680 Miralani Dr., Suite 102, San Diego, CA (US) 92126

( * ) Notice: Subject to any disclaimer, the term of this patent is extended or adjusted under 35 U.S.C. 154(b) by 0 days.

(21) Appl. No.: 12/262,075

(22) Filed: Oct. 30, 2008

(65) Prior Publication Data

US 2009/0106940 A1 Apr. 30, 2009

Related U.S. Application Data

(60) Provisional application No. 60/983,922, filed on Oct. 30, 2007.

(51) Int. Cl.
*E05D 5/06* (2006.01)

(52) U.S. Cl. ..... 16/389; 16/366; 296/146.12

(58) Field of Classification Search ..... 16/389, 16/367, 366, 302, 287; 296/146.11, 146.12, 296/146.9
See application file for complete search history.

(56) References Cited

U.S. PATENT DOCUMENTS

| | | | | |
|---|---|---|---|---|
| 1,253,641 | A * | 1/1918 | Steele | 16/222 |
| 3,589,069 | A | 6/1971 | Lecomte | |
| 4,719,665 | A * | 1/1988 | Bell | 16/232 |
| 4,854,010 | A * | 8/1989 | Maraghe et al. | 16/360 |
| 5,561,887 | A * | 10/1996 | Neag et al. | 16/334 |
| 6,086,137 | A | 7/2000 | Leschke et al. | |
| 6,629,337 | B2 * | 10/2003 | Nania | 16/334 |
| 6,676,193 | B1 | 1/2004 | Hanagan | |
| 6,820,918 | B1 | 1/2004 | DeBono | |
| 6,808,223 | B1 | 10/2004 | Baum et al. | |
| 6,845,547 | B2 | 1/2005 | Ham | |
| 6,942,277 | B2 * | 9/2005 | Rangnekar et al. | 296/146.11 |
| 6,974,177 | B2 * | 12/2005 | Castillo | 296/146.12 |
| 7,059,655 | B2 | 6/2006 | Ham | |
| 7,140,075 | B2 | 11/2006 | Ham | |
| 7,162,775 | B2 | 1/2007 | Hoffman | |
| 7,210,200 | B2 | 5/2007 | Hoffman | |
| 7,347,483 | B2 | 5/2008 | DeBono | |
| 2002/0073507 | A1 * | 6/2002 | Presley | 16/333 |
| 2003/0097731 | A1 * | 5/2003 | Nania | 16/334 |
| 2004/0256882 | A1 | 12/2004 | McRobert | |
| 2006/0200947 | A1 | 9/2006 | Ham | |
| 2007/0138823 | A1 | 6/2007 | Hoffman | |
| 2007/0245525 | A1 | 10/2007 | Hoffman | |
| 2007/0283535 | A1 | 12/2007 | Hoffman | |
| 2008/0083089 | A1 | 4/2008 | Hoffman | |
| 2008/0083090 | A1 | 4/2008 | Hoffman | |
| 2009/0070960 | A1 * | 3/2009 | Elliott et al. | 16/334 |

FOREIGN PATENT DOCUMENTS

| | | |
|---|---|---|
| WO | WO2004048138 | 6/2004 |

* cited by examiner

*Primary Examiner*—William L. Miller
(74) *Attorney, Agent, or Firm*—Marc E. Hankin; Kevin E. Schraven; Hankin Patent Law, APC

(57) ABSTRACT

Various embodiments of this invention disclose a dual stage vehicle door hinge that: allows a vehicle door to be opened at least one hundred and eighty (180) degrees; is compact; fits most production model vehicles, is inexpensive; is easy to install; is adjustable; and is off-the-shelf available.

18 Claims, 5 Drawing Sheets

DUAL STAGE HIDDEN HINGE

CROSS-REFERENCE TO RELATED APPLICATIONS

Priority is claimed to U.S. Provisional Patent Application Ser. No. 60/983,922, filed on Oct. 30, 2007, and titled "Improvements on a Dual Stage Hidden Hinge." This priority application is incorporated by reference herein as though set forth herein in full.

BACKGROUND OF THE INVENTION

This invention generally relates to hinge devices. Specifically, it pertains to a dual stage hinge of a vehicle door that allows the door to open at least one hundred and eighty (180) degrees.

Vehicle door hinges are typically heavy-duty utilitarian hinges that allow the vehicle driver and passengers to enter and exit the vehicle in a routine manner. Vehicle doors are usually attached to the vehicle at the front edge of the vehicle door, and they swing outward from vehicle within a very limited horizontal range. Additionally, many vehicle doors are attached to the vehicle frame at two hinge connection points, which severely limits the doors range of motion.

Although vehicle door hinges are not always limited to less than ninety (90) degrees of opening range, currently very few hinges offer the ability to open a vehicle door over one hundred and sixty-eight (168) degrees.

When the rear doors of a vehicle with more than two (2) doors, such as a sedan, open by swinging out towards the back of the vehicle, such doors are called "suicide doors." Currently no hinge offers the ability to open a suicide door over one hundred and sixty-eight (168) degrees. Moreover, the hinges that are available to be installed in rear doors to convert them into suicide doors are, typically, only compatible with four (4) door trucks, and are not compatible with four (4) door sedans. This incompatibility arises because the currently available hinges are too bulky to work with the arch cut shape of a typical sedan's rear doors.

In the area of dual stage vehicle door hinges, one type that is available is disclosed by U.S. Pat. No. 6,942,277, issued to Rangnekar, et al. (Rangnekar). However, Rangnekar discloses a pair of lightweight hinges that are connected with a rod. Additionally, the Rangnekar hinge is bulky and not designed to fit virtually every production model vehicle. The Rangnekar hinge also has a door stop mechanism that is external to the hinge housing. Finally, the Rangnekar hinge does not feature an adjustable maximum opening stop.

Thus, there remains a long felt need in the art for a dual stage vehicle door hinge that: allows a vehicle door to be opened at least one hundred and eighty (180) degrees; is compact; fits most production model vehicles, is inexpensive; is easy to install; is adjustable; and is off-the-shelf available.

BRIEF SUMMARY OF THE INVENTION

To minimize the limitations in the prior art, and to minimize other limitations that will become apparent upon reading and understanding the present specification, the present invention discloses a dual stage vehicle door hinge that: allows a vehicle door to be opened at least one hundred and eighty (180) degrees; is compact; fits most production model vehicles, is inexpensive; is easy to install; is adjustable; and is off-the-shelf available.

One embodiment of this invention is a dual stage vehicle door hinge, comprising: a chassis housing; a door housing; a first stage hinge housing; a second stage hinge housing; a first stage hinge pin; a second stage hinge pin; a swing arm; a maximum opening stop wing; a maximum opening stop unit; a sequential hinge control device; a maximum opening stop adjuster; a hinge friction device; and a closing stop adjuster. The swing arm has a chassis end and a door end. The first stage hinge pin, the first stage hinge housing, and the swing arm chassis end comprise a first stage hinge axis. The second stage hinge pin, the second stage hinge housing, and the swing arm door end comprise a second stage hinge axis. The swing arm chassis end is connected to the first stage hinge pin and the swing arm door end is connected to the second stage hinge pin. The chassis housing and the door housing are open on a front side. The chassis housing is attached to a vehicle chassis and the door housing is attached to a vehicle door. The maximum opening stop wing is attached to the swing arm door end. The maximum opening stop unit is attached to the second stage hinge housing. A second stage opening movement is stopped when the maximum opening stop wing swings into contact with the maximum opening stop unit. The maximum opening stop adjuster is attached to the maximum opening stop wing and the second stage opening movement is stopped when the maximum opening stop adjuster contacts the maximum opening stop unit. The sequential hinge control device comprises a sequential hinge control arm, a sequential hinge control door end lever, a sequential hinge control chassis end lever, and a sequential hinge control pin. The sequential hinge control device has a right angle hook finger that controls a beginning of said second stage opening movement. The sequential hinge control device requires that a completely closed vehicle door have an opening sequence that comprises a first stage opening movement and the second stage opening movement. The first stage opening movement is on the first stage hinge axis and the second stage opening movement is on the second stage hinge axis. The sequential hinge control device requires that a completely open vehicle door have a closing sequence that comprises a first stage closing movement and a second stage closing movement. The first stage closing movement is on the second stage hinge axis. The second stage closing movement is on the first stage hinge axis. The first stage opening movement opens the vehicle door approximately ninety (90) degrees from a closed position and the second stage opening movement does not begin until the first stage opening movement is complete. The second stage opening movement begins after the first stage opening movement is complete and opens the vehicle door at least one hundred eighty (180) degrees from the closed position. The chassis housing and door housing nest in a front side to front side manner, when the vehicle door is completely closed and the dual stage vehicle door hinge is completely enclosed within the chassis housing and the door housing. The closing stop adjuster is connected to the swing arm. The closing stop adjuster stops the first closing movement and allows the second closing movement to begin. The hinge friction device comprises a hinge friction roller and a hinge friction resistance unit. The hinge friction roller is attached to the swing arm and the hinge friction resistance unit is attached to the first stage hinge housing. The hinge friction device provides resistance to the first stage opening movement and resistance to the second stage closing movement. The dual stage vehicle door hinge is attached to a rear vehicle door. The dual stage vehicle door hinge is attached to a rear side of a vehicle door.

An object of the present invention is to provide a vehicle door that will overcome the deficiencies of the prior art.

Another object of the present invention is to provide a dual stage vehicle door hinge that allows a vehicle door to open at least one hundred and eighty degrees.

Another object of the present invention is to provide a vehicle door hinge that is compact and compatible with a four (4) door sedan's rear doors.

Another object of the present invention is to provide a vehicle door hinge that is safe and easy to use, and allows for safe and easy entrance and exit from the vehicle.

Another object of the present invention is to provide a durable vehicle door hinge that may be used by a wide variety of people regardless of their body size or strength. Indeed, the invention is well suited to allow people with physical disabilities to have easier access to the interior of their vehicle.

Another object of the present invention is to provide a compact inexpensive, easy to install, and off-the-shelf vehicle door hinge that can be installed on a vehicle door to convert the door into a suicide door.

Other features and advantages are inherent in the vehicle door hinge claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown, by way of illustration, a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

In the following description, certain terminology is used to describe certain features of one or more embodiments of the invention. For instance "adjuster" refers to any adjustment device, such as a pin or screw, that once adjusted remain in place until purposefully readjusted.

Figure 1:
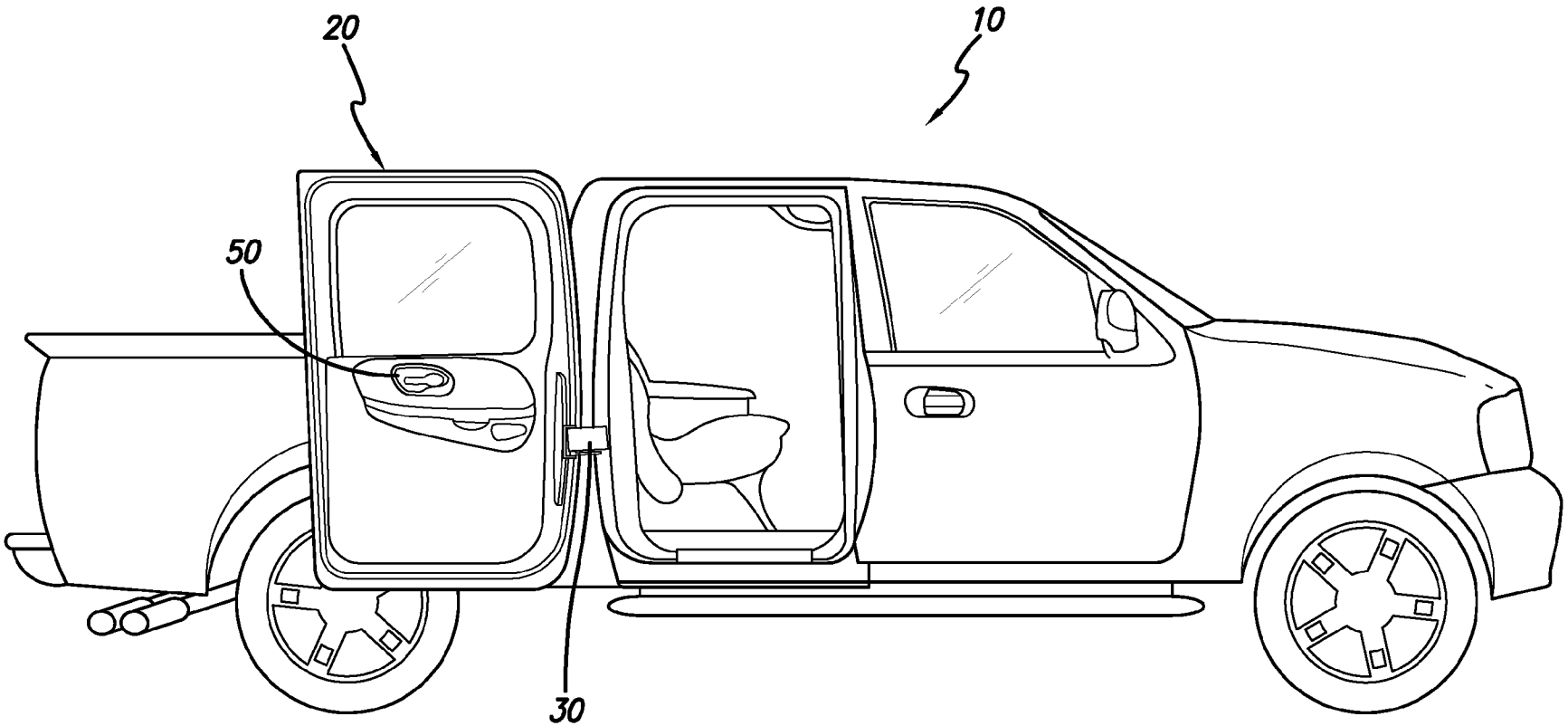
FIG. 1 is an illustration of a side view of a vehicle with one embodiment of the vehicle hinge and shows a vehicle door open at least one hundred and eighty (180) degrees.

FIG. 1 is an illustration of a side view of a vehicle with one embodiment of the vehicle hinge and shows a vehicle door open at least one hundred and eighty (180) degrees. FIG. 1 shows vehicle 10 where rear door 20 has a dual stage hinge 30 that, as preferred, allows the rear door 20 to open one hundred and eighty (180) degrees toward the rear of vehicle 10. A person wishing to enter vehicle 10 simple uses the standard latch (not shown in FIG. 1) on the outside of vehicle door 20. To close vehicle door 20, the person may use interior handle 50 the same way they would to close a door with an original manufacturer hinge. However, Dual stage hinge 30 preferably is installed with more robust latches, and strikers which would mount on the B-pillar and leading edge of the door. Additionally, the door latch can be opened with a lever manually actuated in the vehicle door jam, or with a push button controlled electric actuator.

FIG. 1 shows vehicle door 20 open at least one hundred and eighty (180) degrees using only a single dual stage hinge 30.

Figure 2:
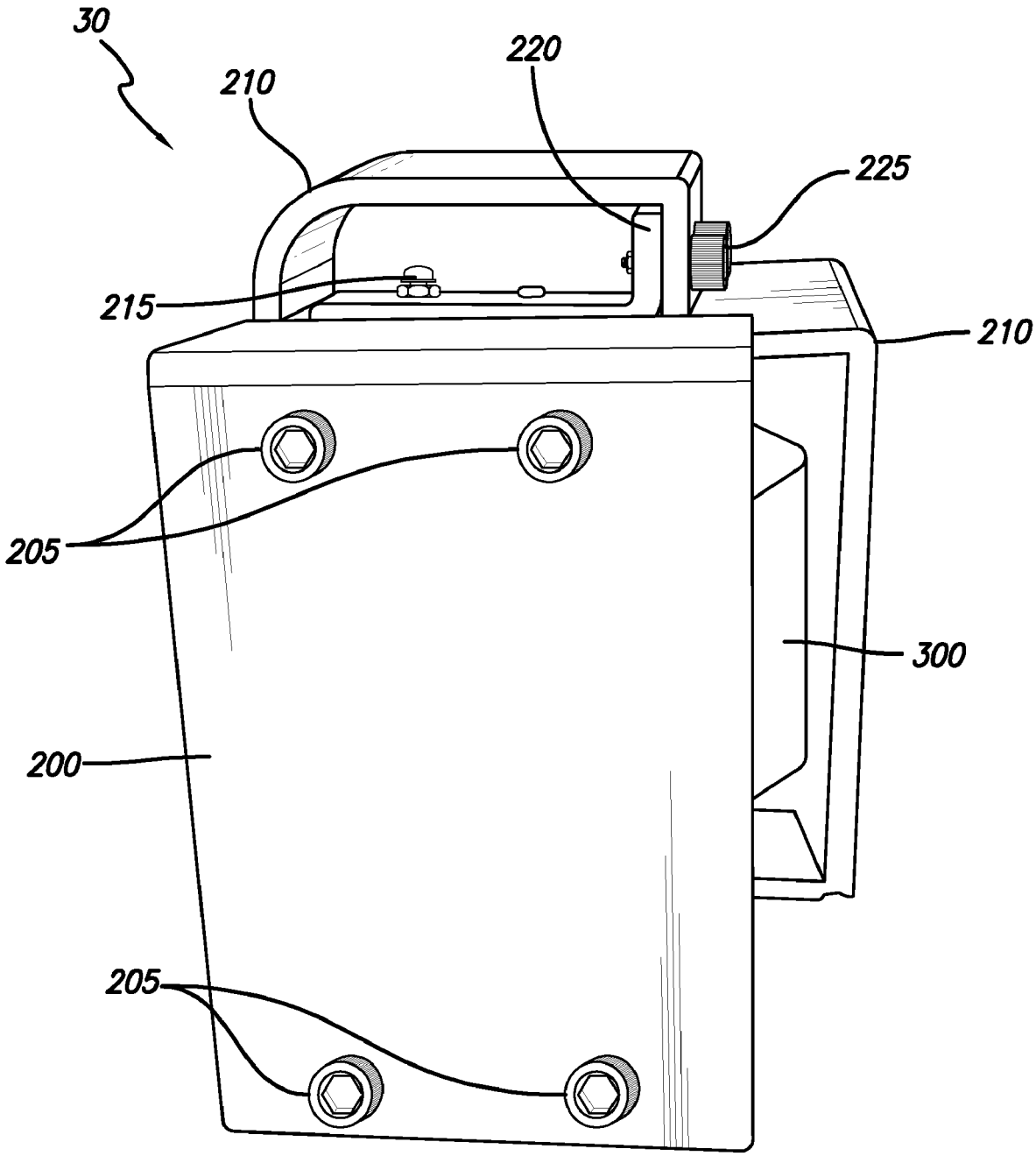
FIG. 2 is an illustration of a side view of one embodiment of the vehicle hinge in a closed position.

FIG. 2 is an illustration of a side view of one embodiment of the vehicle hinge in a closed position. FIG. 2 shows dual stage hinge 30, as preferred with door housing 200, housing connectors 205 and 225, first stage hinge pin connector 215, chassis housing 210, first stage hinge housing 220, and swing arm 300. FIG. 2 shows how dual stage hinge 30 appears when the vehicle door is closed. As shown in FIG. 2 door housing 200 and chassis housing 210 preferably nest in an open face to open face manner when the vehicle door is closed. Door housing 200, as shown in FIG. 2 preferably attaches to the inner rear edge of a vehicle door (not shown in FIG. 2) through welding. Housing connectors 205 are used to bolt door housing 200 to a second stage hinge housing, which is not shown in FIG. 2. Although welding is the preferred connection means between the vehicle door and door housing 200, any means may be used, including, but not limited to, nails, screws, friction, straps, zip-ties, chains, clips, binders, bungees, cords, ropes, strings, cables, fasteners, staples, hook and loop, bands, latches, stitches, snaps, wenches, glue, other natural or synthetic chemical adhesives, adhesive tape, heat bonding, chemical bonding, crimps, clamps, or ultrasonic welding. Moreover, although bolt connectors are the preferred choice for connecting various parts of dual stage hinge 30 to each other, and welding is the preferred choice for connecting the chassis housing 210 to the vehicle chassis (not shown in FIG. 2), these connections can be accomplished through any means, including those in the list immediately above. FIG. 2 also shows that that first stage hinge housing 220 is preferably connected to chassis housing 210 via bolts.

FIG. 2 also shows how swing arm 300 rests all the way inside door housing 200 and chassis housing 210. FIG. 2 shows the preferred, compact design of dual stage hinge 30. It is this compact design that allows dual stage hinge 30 to be installed in virtually every production model vehicle.

The parts of dual stage hinge 30 are preferably made of metal alloy, but they can be made from any natural or synthetic material, including, but not limited to: metal; metal alloy; wood or other fibrous plant products; glass; composite materials such as graphite, fiberglass, boron, or Kevlar; admixtures of plastic resins combined with metal, metal alloy, wood or other fibrous plant products, glass, or composite materials; plastic; animal materials; or any combination of these materials, without departing from the scope of the present invention. Preferably the materials that the parts of dual stage hinge 30 are made of will support the weight of a vehicle door that is open at least one hundred and eighty (180) degrees.

Figure 3:
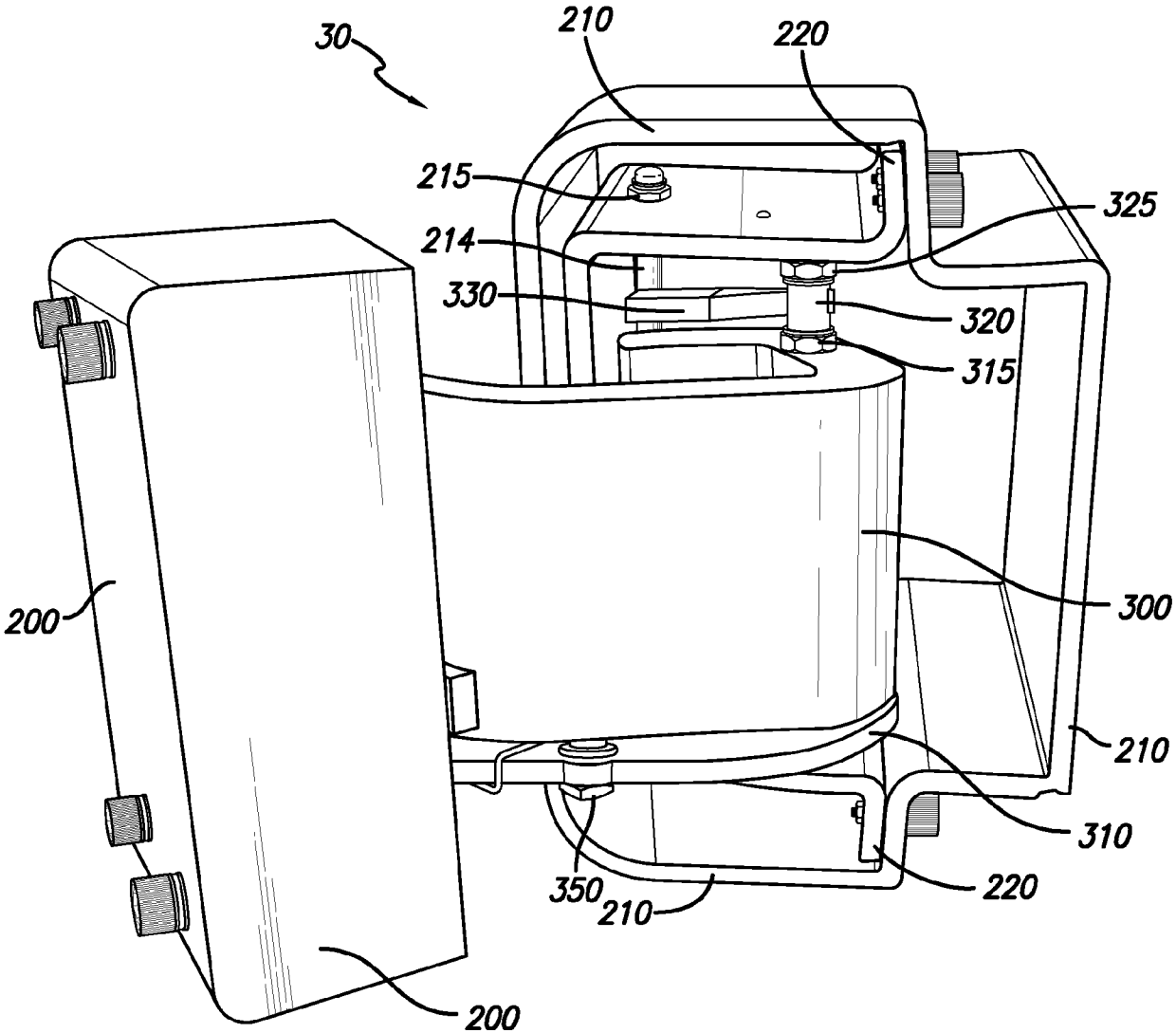
FIG. 3 is an illustration of a side view of one embodiment of the vehicle hinge in a partially open position.

FIG. 3 is an illustration of a side view of one embodiment of the vehicle hinge in a partially open position. FIG. 3 shows how dual stage hinge 30 preferably opens with a first stage opening movement. Indeed the dual stage hinge 30 is shown partially through a first stage opening movement.

FIG. 3 shows dual stage hinge 30, as preferred, with door housing 200, chassis housing 210, swing arm 300, first stage hinge housing 220, hinge friction roller 320, hinge friction resistance unit 330, sequential hinge control device 310, and sequential hinge control pin 350, first stage hinge pin connector 215, first stage hinge pin 214, hinge friction device fastener 325, and hinge friction device spacer 315. FIG. 3 shows how door housing 200, during a preferred first stage opening movement, swings away from chassis housing 210. Swing arm 300, as shown in FIG. 3, continues to connect door housing 200 with chassis housing 210. During the first stage opening movement door housing 200 preferably swings out until it is approximately ninety (90) degrees away from chassis housing 210.

FIG. 3 also shows how first stage hinge housing 220 fits within chassis housing 210.

As shown in FIG. 3, first stage hinge pin 214 is housed in first stage hinge housing 220. First stage hinge pin 214 is attached to first stage hinge housing 220 through first stage hinge pin connector 215. Although not shown in FIG. 3, swing arm 300 preferably connects to first stage hinge housing 220 via a dual knuckle alternating hinge that is known in the art of hinges. First stage hinge pin 214 is the hinge pin that connects the swing arm knuckles and the first stage hinge housing knuckles. First stage hinge axis hinges at first stage hinge pin 214. Preferably swing arm 300 swings freely at the first stage hinge axis, subject only to the limitations of the vehicle door's skin and the edges of the first stage hinge housing 220, the friction forces generated by hinge friction roller 320, and the friction generated by sequential hinge control device 310. The first stage hinge movement is essentially the swing arm swinging way from chassis housing 210 on the first stage hinge axis.

To provide compact and internal friction to the opening and closing movements of the dual stage hinge, hinge friction roller 320 slides along friction resistance unit 330 during the first stage opening movements and the second stage closing movements.

Finally, FIG. 3 shows how sequential hinge control device 310 preferably runs along the bottom of swing arm 300 and is bolted to swing arm 300 with sequential hinge control pin 350.

Figure 4:
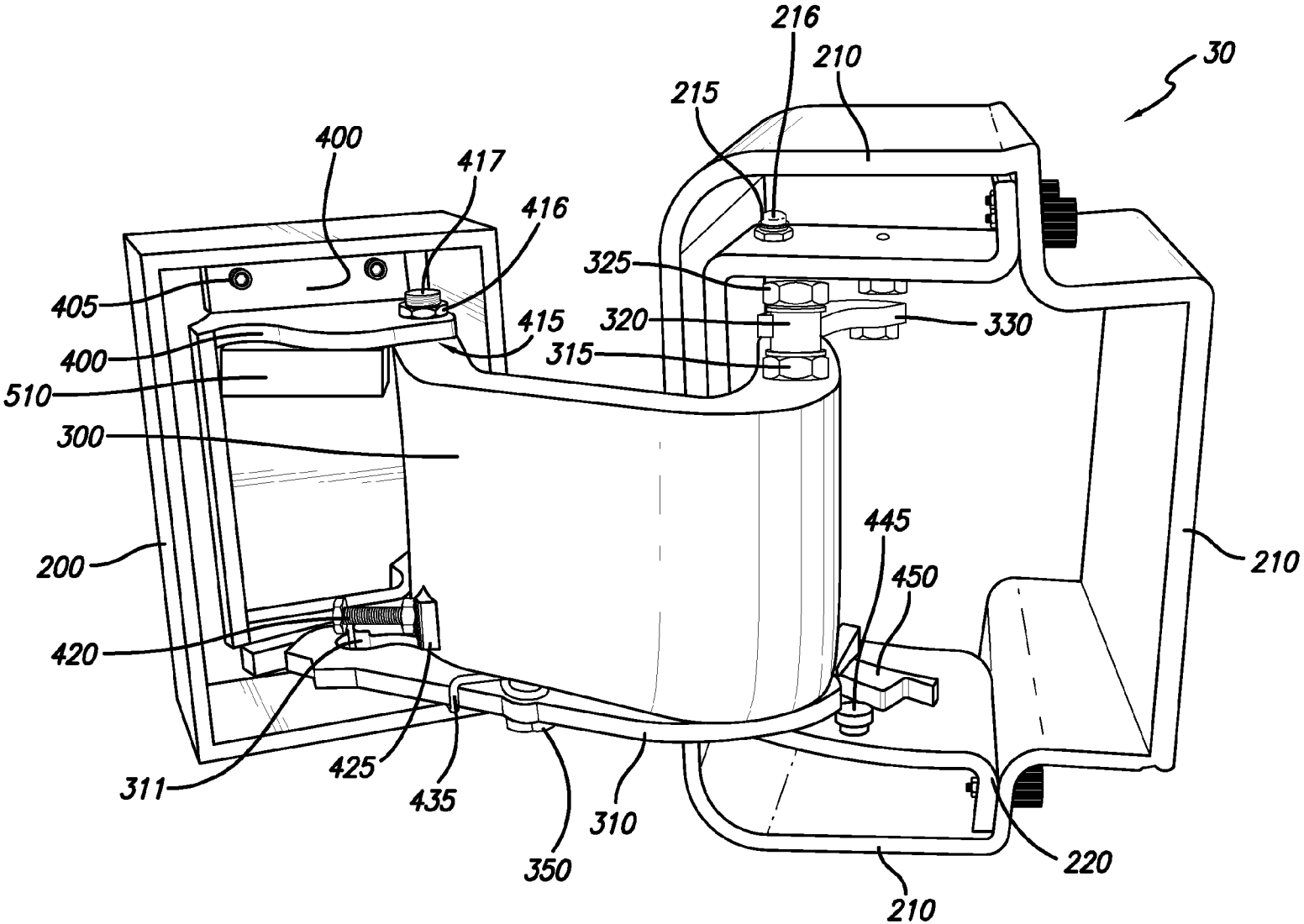
FIG. 4 is an illustration of a side view of one embodiment of the vehicle hinge in an open position.

FIG. 4 is an illustration of a side view of one embodiment of the vehicle hinge in an open position. FIG. 4 shows dual stage hinge 30, as preferred, with chassis housing 210, first stage hinge housing 220, swing arm 300, sequential hinge control device 310, first stage hinge connector 215, first stage hinge axis 216, hinge friction device connectors 315 and 325, hinge friction roller 320, hinge friction resistance unit 330, sequential hinge control pin 350, sequential hinge control chassis end lever 450, sequential hinge control chassis pin 445, sequential hinge control door end lever 311, sequential hinge control tension spring 435, door housing 200, second stage hinge housing 400, second stage hinge housing threaded hole 405, second stage hinge connector 416, second stage hinge axis 415, second stage hinge pin 417, closing stop adjuster 420, second stage hinge closing stop reinforcement 425, maximum opening stop unit 510.

Dual stage hinge 30, as shown in the preferred embodiment in FIG. 4, is in the second stage hinge opening movement, and the hinge is almost completely open. When dual stage hinge 30 is completely open, the outer face of the chassis housing 210 and door housing 200 are essentially parallel.

FIG. 4 shows the preferred goose neck shape of swing arm 300. The curved shape of swing arm 300 should allow dual stage hinge 30 to open to at least one hundred and eighty (180) degrees.

FIG. 4 shows how the first stage hinge opening movement is complete and swing arm 300 has swung completely away from chassis housing 210. First stage hinge axis 216 is a convergence of a first stage hinge pin 214 (not shown in FIG. 4), the chassis end of swing arm 300, and the hinge knuckles of first stage hinge housing 210.

Second stage hinge axis 415 comprises second stage hinge pin 417, the door end of swing arm 300, and an edge of second stage hinge housing 400.

As shown in FIG. 4, second stage hinge opening movement is stopped by maximum opening stop unit 510. The preferred embodiment of the maximum stop opening is discussed below in FIG. 5.

Preferably the closing movements of dual stage hinge 30 are a mirror image of the opening movements. That is, the second stage hinge of the opening movement is the first to close and the first stage hinge of the opening movement is the second to close. The first stage closing movement, which involves second stage hinge axis 415, is accomplished by second stage hinge housing 400 (along with door housing 200) swinging back toward chassis housing 210. The first stage closing movement is stopped when second stage hinge housing 400 contacts closing stop adjuster 420. Once the first stage closing movement is stopped, the second stage closing movement, which involves the first stage hinge axis, begins. The second stage closing movement is complete when the door is completely closed.

Sequential hinge control device 310 is very similar to sequential hinge control devices known in the art, however, sequential hinge control device 310 is improved over the prior art because of the unique finger shape at the chassis end of sequential hinge control device 310. The very tip of the chassis end of sequential hinge control device 310, as shown in FIG. 4, has a right angle hook, or finger, that catches the backside of sequential hinge control chassis end lever 450 at the last portion of the first stage opening movement. The finger is then pushed back by sequential hinge control chassis pin 445 just as the first stage opening is complete, causing sequential hinge control device 310 to pivot on sequential hinge control pin 350. Sequential hinge control device 310 then resists the force of sequential hinge control tension spring 435 and lifts the hook of sequential hinge control door end lever 311 out of the locking profile at the base of the second stage housing, which allows the second stage opening movement of the hinge to begin.

Preferably the closing movements of dual stage hinge 30 are a mirror image of the opening movements. That is, the second stage hinge of the opening movement is the first to close and the first stage hinge of the opening movement is the second to close. The first stage closing movement starting from the fully open position, which involves second stage hinge axis 415, is accomplished by the second stage housing 400 (along with door housing 200) swings back toward chassis housing 210 pivoting on axis 415 until contacting the closing stop adjuster 420. Once the first stage closing movement is stopped, the sequential hinge control device 310 pivoting on sequential hinge control pin 350 motivated by sequential hinge control tension spring 435 to bring sequential hinge control door end lever 311 into the profile opening provided by the closing of the second stage which moves the chassis end of sequential hinge control device 310 out and away from sequential hinge control chassis pin 445 so that the second stage closing movement, which involves the first stage hinge axis 216 begins. The second stage closing movement is complete when the door is completely closed. This sequential control of first stage hinge axis 216, and second stage hinge axis 415 by interaction of the sequential hinge control device 310 with all of the elements described ensure that the opening and closing movements of dual stage hinge 30 are done smoothly and in the appropriate order.

Figure 5:
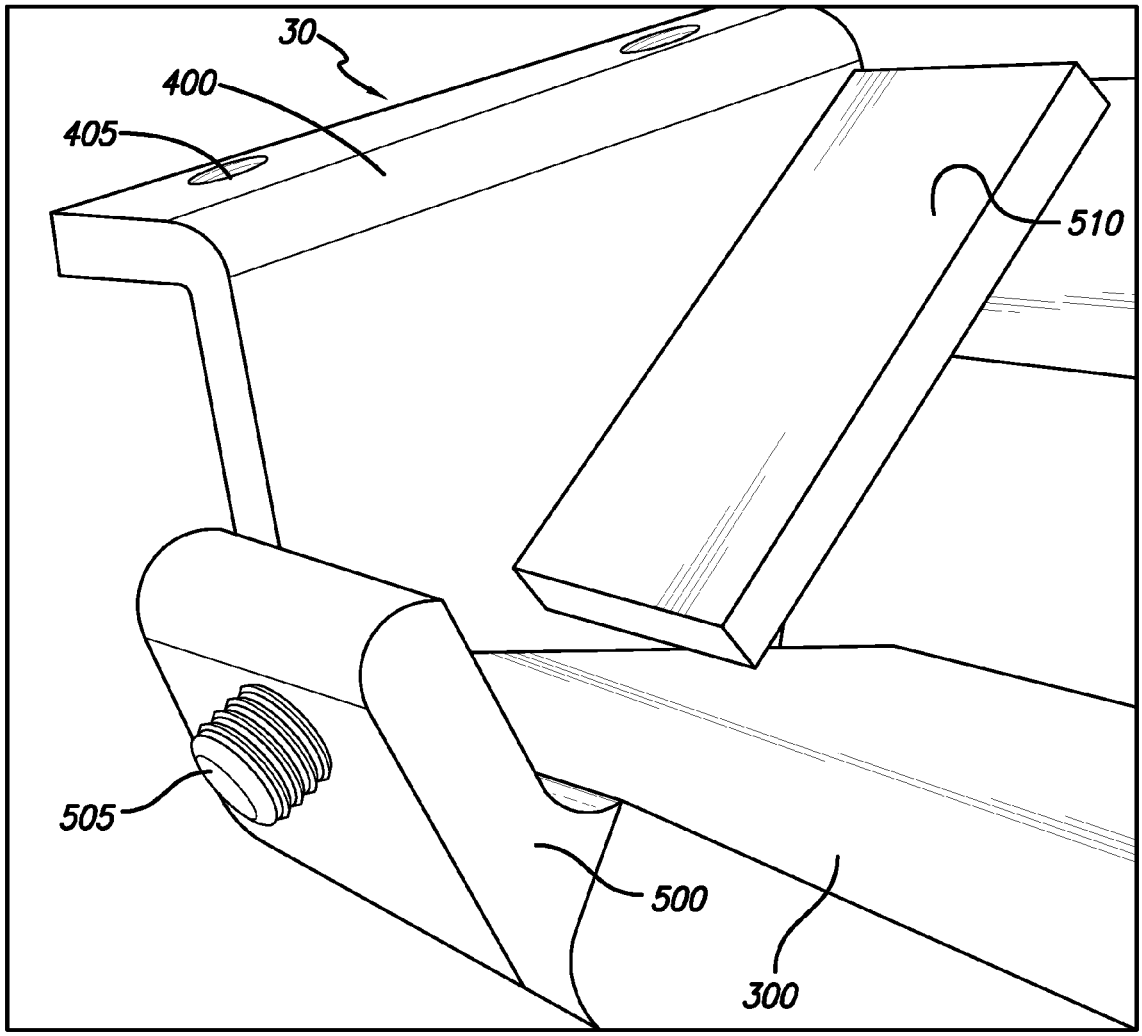
FIG. 5 is a detailed illustration an internal view of one embodiment of the vehicle hinge and shows the maximum opening stop.

FIG. 5 is a detailed illustration an internal view of one embodiment of the vehicle hinge and shows the maximum opening stop. FIG. 5 shows dual stage hinge 30, as preferred, with second stage hinge housing 400, second stage hinge housing threaded hole 405, swing arm 300, maximum opening stop wing 500, maximum opening stop adjuster 505, and maximum opening stop unit 510. Maximum opening stop unit 510 is preferably attached via weld or bolt to second stage hinge housing 400. Maximum opening stop wing 500 is preferably attached to swing arm 300. As shown in FIG. 5, maximum opening stop adjuster 505 is preferably a screw type adjuster. When second stage hinge housing 400 swings open, during the second stage opening movement, maximum opening stop wing 500 approaches the backside of maximum opening stop unit 510. When maximum opening stop wing 500 or maximum opening stop wing adjuster 505, as preferred, contacts the backside of maximum opening stop wing unit 510, the second stage opening movement is stopped and the vehicle door is now completely open.

In summary, the present invention is a dual stage hinge that: allows a vehicle door to be opened at least one hundred and eighty (180) degrees; is compact; fits most production model vehicles, is inexpensive; is easy to install; is adjustable; and is off-the-shelf available.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A dual stage vehicle door hinge, comprising:
a chassis housing;
a door housing;
a first stage hinge housing;
a second stage hinge housing;
a first stage hinge pin;
a second stage hinge pin;
a swing arm;
a maximum opening stop wing;
a maximum opening stop unit; and
a maximum opening stop adjuster;
wherein said swing arm has a chassis end and a door end;
wherein said first stage hinge pin, said first stage hinge housing, and said swing arm chassis end comprise a first stage hinge axis;
wherein said second stage hinge pin, said second stage hinge housing, and said swing arm door end comprise a second stage hinge axis;
wherein said swing arm chassis end is connected to said first stage hinge pin;
wherein said swing arm door end is connected to said second stage hinge pin;
wherein said chassis housing and said door housing are open on a front side;
wherein said chassis housing is attached to a vehicle chassis;
wherein said door housing is attached to a vehicle door;
wherein said chassis housing is connected to said first stage hinge housing; and
wherein said door housing is connected to said second stage hinge housing;
wherein said first stage hinge pin is connected to said first stage hinge housing;
wherein said second stage hinge pin is connected to said second stage hinge housing;
wherein said maximum opening stop wing is attached to said swing arm door end;
wherein said maximum opening stop unit is attached to said second stage hinge housing; and
wherein a second stage opening movement stops when said maximum opening stop wing contacts said maximum opening stop unit;
wherein said maximum opening stop adjuster is connected to said maximum opening stop wing; and
wherein said second stage opening movement stops when said maximum opening stop adjuster contacts said maximum opening stop unit.

2. The dual stage vehicle door hinge of claim 1, wherein said chassis housing and said door housing nest in a front side to front side manner, when said vehicle door is completely closed; and
wherein said dual stage vehicle door hinge is completely enclosed within said chassis housing and said door housing when said vehicle door is completely closed.

3. The dual stage vehicle door hinge of claim 2, further comprises:
a sequential hinge control device;
wherein said sequential hinge control device comprises a sequential hinge control arm, a sequential hinge control door end lever, a sequential hinge control chassis end lever, and a sequential hinge control pin;
wherein said sequential hinge control device requires that a completely closed vehicle door have an opening sequence that comprises a first stage opening movement and said second stage opening movement;
wherein said first stage opening movement is on said first stage hinge axis;
wherein said second stage opening movement is on said second stage hinge axis; and
wherein said sequential hinge control device has a right angle hook finger that controls a beginning of said second stage opening movement.

4. The dual stage vehicle door hinge of claim 3, wherein said sequential hinge control device requires that a completely open vehicle door have a closing sequence that comprises a first stage closing movement and said second stage closing movement;
wherein said first stage closing movement is on said second stage hinge axis; and
wherein said second stage closing movement is on said first stage hinge axis.

5. The dual stage vehicle door hinge of claim 4, wherein said first stage opening movement opens said vehicle door approximately ninety (90) degrees from a closed position; and
wherein said second stage opening movement does not begin until said first stage opening movement is complete.

6. The dual stage vehicle door hinge of claim 5, wherein said second stage opening movement begins after said first stage opening movement is complete, and opens said vehicle door at least one hundred and eighty (180) degrees from said closed position.

7. The dual stage vehicle door hinge of claim 6, further comprises:

a closing stop adjuster;

wherein said closing stop adjuster is connected to said swing arm; and wherein said closing stop adjuster stops said first closing movement and allows said second closing movement to begin.

8. The dual stage vehicle door hinge of claim 7, further comprises:

a hinge friction device;

wherein said hinge friction device comprises a hinge friction roller and a hinge friction resistance unit;

wherein said hinge friction roller is attached to said swing arm, and said hinge friction resistance unit is attached to said first stage hinge housing; and wherein said hinge friction device provides resistance to said first stage opening movement, and provides resistance to said second stage closing movement.

9. The dual stage vehicle door hinge of claim 8, wherein said dual stage vehicle door hinge is attached to a rear vehicle door.

10. The dual stage vehicle door hinge of claim 9, wherein said dual stage vehicle door hinge is attached to a rear side of a vehicle door.

11. The dual stage vehicle door hinge of claim 5, wherein said second stage opening movement begins after said first stage opening movement is complete and opens said vehicle door at least one hundred and eighty (180) degrees from said closed position; and wherein said dual stage vehicle door hinge is attached to a rear side of a rear vehicle door.

12. A dual stage vehicle door hinge, comprising:

a chassis housing;

a door housing;

a first stage hinge housing;

a second stage hinge housing;

a first stage hinge pin;

a second stage hinge pin;

a swing arm; and a hinge friction device;

wherein said swing arm has a chassis end and a door end;

wherein said first stage hinge pin, said first stage hinge housing, and said swing arm chassis end comprise a first stage hinge axis;

wherein said second stage hinge pin, said second stage hinge housing, and said swing arm door end comprise a second stage hinge axis;

wherein said swing arm chassis end is connected to said first stage hinge pin;

wherein said swing arm door end is connected to said second stage hinge pin;

wherein said chassis housing and said door housing are open on a front side;

wherein said chassis housing is attached to a vehicle chassis;

wherein said door housing is attached to a vehicle door;

wherein said hinge friction device comprises a hinge friction roller and a hinge friction resistance unit;

wherein said hinge friction roller is attached to said swing arm, and said hinge friction resistance unit is attached to said first stage hinge housing;

wherein said hinge friction device provides resistance to said first stage opening movement, and provides resistance to said second stage closing movement;

wherein said chassis housing is connected to said first stage hinge housing;

wherein said door housing is connected to said second stage hinge housing;

wherein said first stage hinge pin is connected to said first stage hinge housing; and wherein said second stage hinge pin is connected to said second stage hinge housing.

13. The dual stage vehicle door hinge of claim 12, further comprises:

a closing stop adjuster;

wherein said closing stop adjuster is connected to said swing arm; and wherein said closing stop adjuster stops said first closing movement and allows said second closing movement to begin.

14. The dual stage vehicle door hinge of claim 13, further comprises:

a maximum opening stop wing; and a maximum opening stop unit;

wherein said maximum opening stop wing is attached to said swing arm door end;

wherein said maximum opening stop unit is attached to said second stage hinge housing; and wherein a second stage opening movement stops when said maximum opening stop wing swings into contact with said maximum opening stop unit.

15. The dual stage vehicle door hinge of claim 14, further comprises:

a maximum opening stop adjuster;

wherein said maximum opening stop adjuster is connected to said maximum opening stop wing; and wherein said second stage opening movement stops when said maximum opening stop adjuster contacts said maximum opening stop unit.

16. The dual stage vehicle door hinge of claim 15, wherein said chassis housing and said door housing nest in a front side to front side manner, when said vehicle door is completely closed; and wherein said dual stage vehicle door hinge is completely enclosed within said chassis housing and said door housing, when said vehicle door is completely closed.

17. The dual stage vehicle door hinge of claim 16, further comprises:

a sequential hinge control device;

wherein said sequential hinge control device comprises a sequential hinge control arm, a sequential hinge control door end lever, a sequential hinge control chassis end lever, and a sequential hinge control pin;

wherein said sequential hinge control device requires that a completely closed vehicle door have an opening sequence that comprises a first stage opening movement and said second stage opening movement;

wherein said first stage opening movement is on said first stage hinge axis;

wherein said second stage opening movement is on said second stage hinge axis;

wherein said sequential hinge control device has a right angle hook finger that controls a beginning of said second stage opening movement;

wherein said sequential hinge control device requires that a completely open vehicle door have a closing sequence that comprises a first stage closing movement and said second stage closing movement;

wherein said first stage closing movement is on said second stage hinge axis; and wherein said second stage closing movement is on said first stage hinge axis.

18. The dual stage vehicle door hinge of claim 17, wherein said first stage opening movement opens said vehicle door approximately ninety (90) degrees from a closed position; and wherein said second stage opening movement does not begin until said first stage opening movement is complete.

* * * * *